US005479759A

United States Patent [19]

Gorlich et al.

[11] Patent Number: 5,479,759

[45] **Date of Patent: * Jan. 2, 1996**

[54] METHOD AND APPARATUS FOR PACKAGING FOOD

[75] Inventors: Michael P. Gorlich; Robert F. McPherson, Jr., both of Hilton Head Island, S.C.

[73] Assignee: World Class Packaging Systems, Inc., Hilton Head Island, S.C.

[ * ] Notice: The portion of the term of this patent subsequent to May 30, 2012, has been disclaimed.

[21] Appl. No.: 360,567

[22] Filed: Dec. 21, 1994

Related U.S. Application Data

[63] Continuation of Ser. No. 154,756, Nov. 18, 1993, Pat. No. 5,419,097.

[51] Int. Cl.[6] ..... B65B 31/04

[52] U.S. Cl. ..... 53/432; 53/510; 53/478; 53/329.3; 53/298

[58] Field of Search ..... 53/432, 434, 510, 53/511, 477, 478, 329.3, 329.5, 453, 298

[56] References Cited

U.S. PATENT DOCUMENTS

| | | | |
|---|---|---|---|
| 2,426,555 | 8/1947 | Jacobs | 53/432 |
| 3,340,668 | 9/1967 | Bofinger | 53/432 |
| 3,398,500 | 8/1968 | Inman | 53/432 |
| 3,456,421 | 7/1969 | Bippus | 53/511 |
| 3,523,397 | 8/1970 | Carey | 53/453 |
| 3,626,655 | 12/1971 | Eitel | 53/511 |
| 3,664,085 | 5/1972 | Rousseau | 53/510 |
| 3,831,341 | 8/1974 | Gauntlett | 53/432 |
| 4,265,070 | 5/1981 | Mainberger | 53/511 |
| 4,282,698 | 8/1981 | Zimmerman | 53/329.3 |
| 4,312,171 | 1/1982 | Vadas | 53/432 |
| 4,624,099 | 11/1986 | Harder | 53/432 |
| 4,996,826 | 3/1991 | Pfaffmann | 53/478 |
| 5,155,971 | 10/1992 | Zopf | 53/432 |
| 5,371,207 | 12/1993 | Epstein | 53/432 |

FOREIGN PATENT DOCUMENTS

| | | | |
|---|---|---|---|
| 2067157 | 7/1981 | United Kingdom | 53/432 |

*Primary Examiner*—Daniel C. Crane
*Attorney, Agent, or Firm*—Arnold, White & Durkee

[57] ABSTRACT

A method and apparatus for modified atmosphere packaging uses a rotary conveyor to transport a plurality of trays to be packaged between a plurality of stations in a circular arrangement. The trays may be loaded onto a receiving platform by depositing them over movable beds which can reciprocate downwardly in order to permit the trays to be removably held inside slots in a removable platform. Since the platform is removable from the conveyor, it may be centered in any particular station by lifting the platform from the conveyor and guiding it into a precise alignment at a particular station. The package may then be filled, its atmosphere replaced with one lower in oxygen content, and then the desired atmosphere sealed within the package. This can be done in the continuous fashion so that the film is severed from a continuous web. Advantageously, the cutting blades reciprocate with respect to a heat sealing apparatus inside an enclosed environment wherein the cutting blades have internal cooling means to prevent distortions caused by overheating. The various connections for gas and vacuum supply may be quickly disconnected, and an entire station may be changed through the use of quick disconnect connections of the apparatus of the station to a support. The unloading proceeds generally as the reverse or the loading process wherein the trays are pushed upwardly from the platforms and then slid outwardly onto a conveyor.

44 Claims, 9 Drawing Sheets

METHOD AND APPARATUS FOR PACKAGING FOOD

This is a continuation of application Ser. No. 08/154,756, filed on Nov. 18, 1993, now U.S. Pat. No. 5,419,097.

FIELD OF THE INVENTION

This invention relates to machines for packaging food products and related methods such that the packaged product may be maintained in one condition under certain circumstances and then converted to another condition. For example, during transportation the food package might maintain an inert gaseous atmosphere and then, when the package reaches a supermarket or other retail outlet, the food package will permit exposure of the food product to the ambient atmosphere. While a wide variety of food products can be packaged in accordance with the teachings of this invention, it is particularly advantageous in connection with the packaging of meat in a modified atmosphere package such that the meat may be transported in a relatively inert atmosphere and then caused to bloom when it reaches a retail outlet by exposure to oxygen.

BACKGROUND OF THE INVENTION

Historically, meat products have been butchered and packaged in each supermarket or other retail outlet. It has long been recognized that this arrangement is extremely inefficient and expensive. Instead, it would be preferable to permit the meat to be butchered and packaged at an efficient facility which benefits from economies of scale and thereafter shipped to individual supermarkets or other retail outlets.

In the past, this desirable goal has not been achievable because most consumers prefer to buy meat which is red in color as a result of exposure to oxygen. However, the meat maintains its red color for only one to two days. Thereafter, it turns to a purple color which is undesirable to most consumers. Therefore, if the meat was butchered and packaged in one location and then shipped to another location for eventual sale, by the time the package reached the retail outlet the meat would have undergone the transformation to the purple color and would be effectively unsalable.

To overcome these problems, there have been a number of efforts to maintain the food product in a first atmosphere during shipping and a second atmosphere when the meat product is ready for retail sale. It is not believed that any of these techniques have yet achieved significant commercial acceptance. Therefore, it is highly desirable to provide a package that would permit remote meat preparation and subsequent sale after the passage of more than a couple of days. It is equally desirable to have an apparatus and method for packaging such products in an efficient and cost-effective way despite the fact that most consumers would prefer not to invest a large amount of money in elaborate packages.

Thus, it should be apparent that there is a continuing need to solve the longstanding problem of providing a package which permits meat or other food products to be packaged at one location and then to be sold sometime later under different conditions.

SUMMARY OF THE INVENTION

These and other desirable objectives may be achieved by an apparatus for making modified atmosphere packages that includes a plurality of packaging stations. Among these stations is at least one station for loading a food product into a tray. A rotary conveyor moves the trays from one station to the next. The rotary conveyor includes a platform for carrying a plurality of trays. One of the packaging stations is adapted to load the trays on the platform. Another one of the stations is adapted to unload the trays from the platform. An apparatus is included for replacing the ambient atmosphere in the trays with an atmosphere reduced in oxygen content before covering the trays with a packaging film.

In accordance with another aspect of the present invention, a method for making modified atmosphere packaging includes the step of loading a plurality of trays onto a rotary conveyor. The trays are indexed between a plurality of stations arranged in a circular path. The atmosphere within a tray is withdrawn after a food product has been added. The tray is covered with a film to maintain an atmosphere reduced in oxygen content within the tray. The trays are thereafter unloaded from the rotary conveyor.

DESCRIPTION OF THE PREFERRED EMBODIMENT

Figure 1:
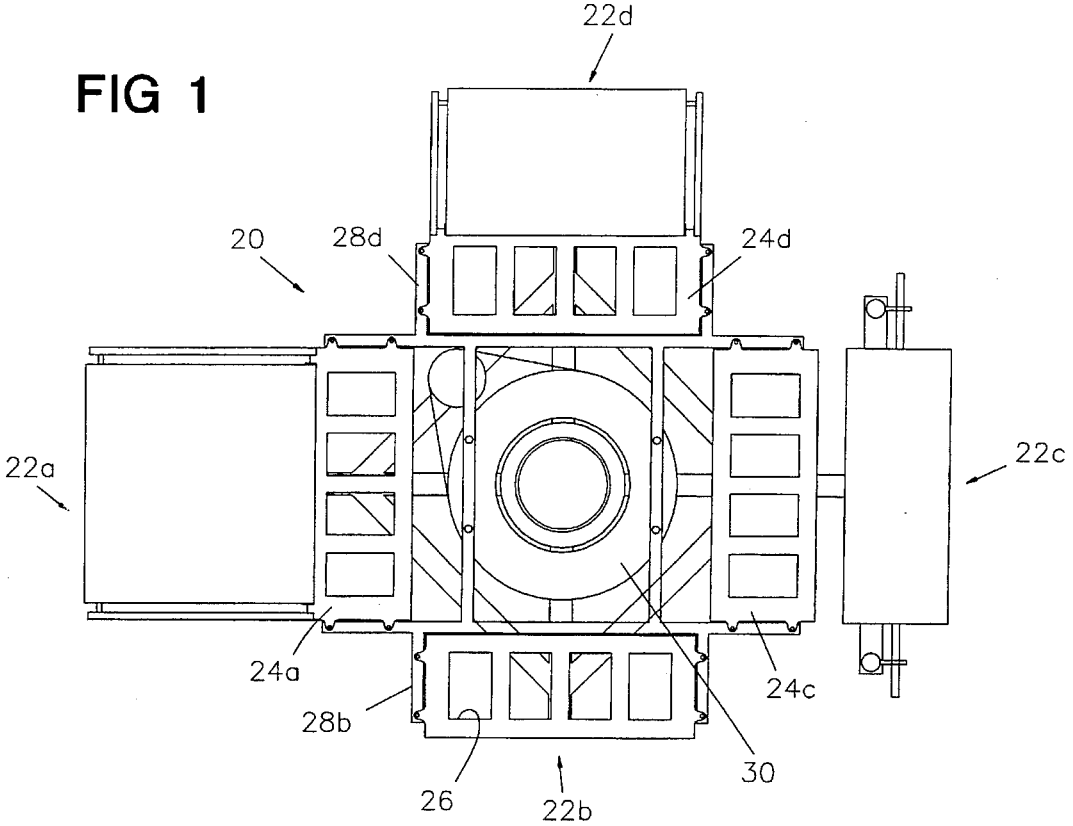
FIG. 1 is a cross-sectional view taken generally along the line 1—1 in FIG. 2.

Referring to the drawings wherein like reference characters are used for like parts throughout the several views, a packaging machine 20, as shown in FIG. 1, includes four stations 22. While the machine is illustrated in a four-station embodiment, it should be understood that one or more of the indicated stations may be unused and that in any particular embodiment it may be possible or desirable to have more or less than four stations. The four stations 22 operate on packages which are moved circularly from one station to the next.

The packages to be produced are held on a platform 24 which in the illustrated embodiment includes slots 26 to receive four package trays. A variety of package types may be utilized. One type of package type uses a relatively rigid molded plastic tray which is covered by either a film or an additional plastic domed closure. Examples of packages of this type are disclosed in applicant's copending patent applications, Ser. Nos. 08/064,700, filed May 20, 1993 now U.S. Pat. No. 5,348,752, and 08/098,530, filed Jul. 28, 1993, now U.S. Pat. No. 5,419,096. Both of these patent applications are hereby expressly incorporated by reference herein.

The platforms 24 are carried on mounting arms 28 which in turn connect to rotatable ring 30. The ring 30 is driven by the mechanism 32 which may be of any conventional type but is illustrated as being a drive chain and motor arrangement.

Figure 2:
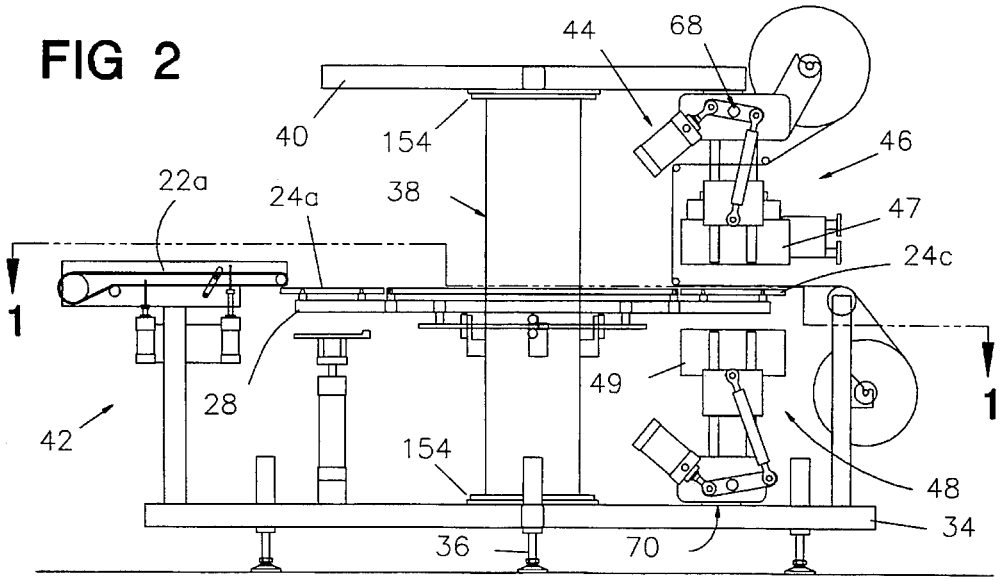
FIG. 2 is a front elevational view of the embodiment shown in FIG. 1.

The entire machine 20 is supported atop a base 34 on feet 36, as shown in FIG. 2. Base 34 also supports a surge tank 38, which in turn supports a hanger assembly 40. The surge tank 38 provides a central support for mounting the ring 30 and drive mechanism 32. The base 34 and hanger assembly 40 may be utilized to support various equipment positioned at the stations 22 for operating on the food trays contained within the platform 24. For example, as shown in FIG. 2, a tray load mechanism 42 is associated with the station 22*a* and supported on the base 34. Similarly, a tooling assembly 44 includes an upper portion 46 mounted on the hanger 40 and a lower portion 48 mounted on the base 34. The upper portion 46 includes a housing or chamber 47 and the lower portion 48 includes a housing or chamber 49.

Figure 5:
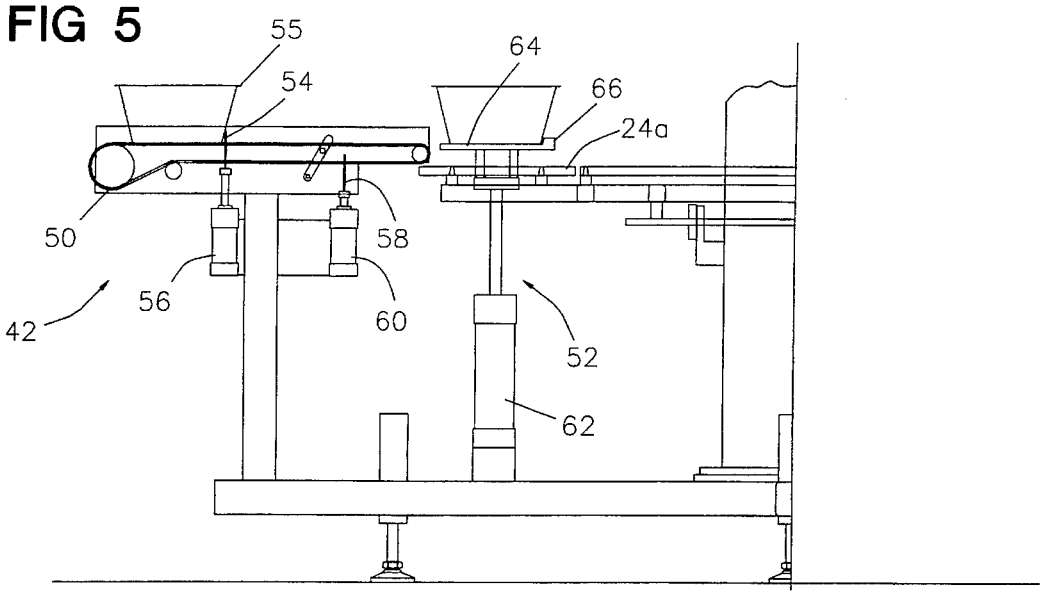
FIG. 5 is a front elevational view corresponding to that shown in FIG. 4 after a row of trays has been positioned atop a receiving platform.

The tray load mechanism 42, shown in FIG. 5, includes a tray conveyor 50 and a tray loader 52. The conveyor 50 may be a conventional belt conveyor wherein the trays 55 are motioned onto the tray conveyor 50. They are aligned by a stop bar 54 powered by a cylinder 56. At the appropriate interval, the trays 55 may be advanced to a second stop bar 58 so that the position previously occupied by the trays 55 may be filled by additional trays. The stop bar 58 is controlled by a second cylinder 60. The trays 55 may be pre-loaded with the food product to be packaged.

Below the platform 24*a*, there is a cylinder 62 that powers a bed 64 upwardly and downwardly. The bed 64 includes a stop 66 on its inward end. Each bed 64 is designed to receive a tray 55 from the tray conveyor 50 and to lower it into a platform slot 26. Thus, there would be a plurality of mechanisms 62 and 64, one for each of the slots 26 in a platform 24*a*.

In the illustrated embodiment, the station 22*b* is an inactive station which is not used. However, in the other applications, it may be desirable or necessary to perform all or part of the operation which is done at another station at the station 22*b*. The station 22*b* could be used, for example, to load the food product into the trays 55.

The station 22*c* includes a tooling assembly 44 made up of an upper portion 46 and a lower portion 48. As shown in FIG. 2, the upper chamber 47 is mounted on a mechanism 68 which allows it to be raised and lowered towards and away from the platform 24. Likewise, the lower chamber 49 is mounted on a mechanism 70 which raises and lowers the lower portion 48 towards the underside of the platform 24. If desired, either the upper chamber 47 or lower chamber 49 may be stationary.

Figure 7:
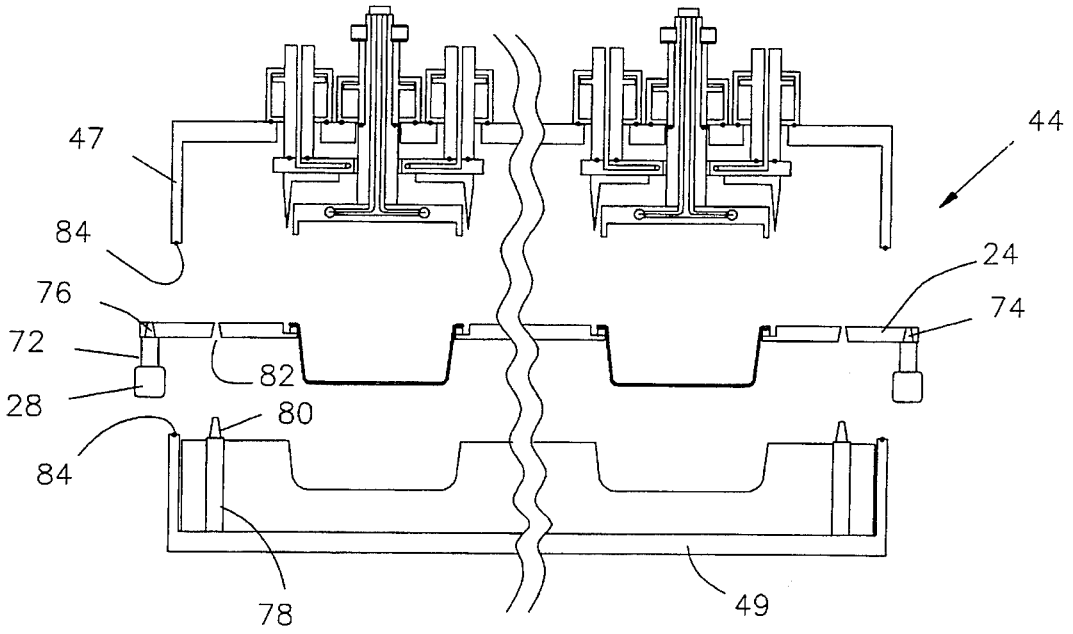
FIG. 7 is a vertical, cross-sectional view partially broken away so as to show two rather than four stations and with vacuum and gas supplying means removed.
Figure 8:
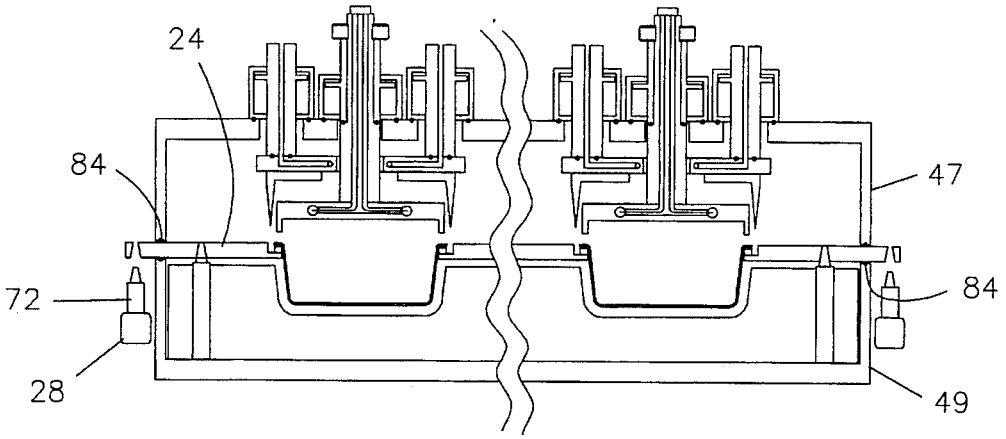
FIG. 8 is a view corresponding to FIG. 7 after the platform has been removed from the rotary arms.

The mounting of a platform 24 on the arms 28 is shown in FIGS. 7 and 8. As shown in FIG. 7, the platform 24 is mounted on the arms 28 by a plurality of upstanding pins 72. Each pin 72 includes a tapered upper portion 74 which fits in a mating tapered portion 76 in the underside of the platform 24. Thus, the platform 24 is removably located on the arms 28 by way of the pins 72.

The lower chamber 49 includes a pair of upstanding pins 78 with tapered portions 80 which mate in holes 82 in the platform 24. Thus, when the lower chamber 49 moves upwardly to engage the platform 24, the tapered portions 80 of the pins 78 mate with the holes 82 in the platform 24. In this way, the platform 24 is very precisely centered and positioned within the station 22*c*. As shown in FIG. 8, the lower chamber 49 actually lifts the platform 24 off of its pins 72 to achieve the precise alignment. The upper chamber 47 and lower chamber 49 contain seals 84 which provide an air tight seal with the upper and lower surfaces of the platform 24, again as shown in FIG. 8.

Figure 10:
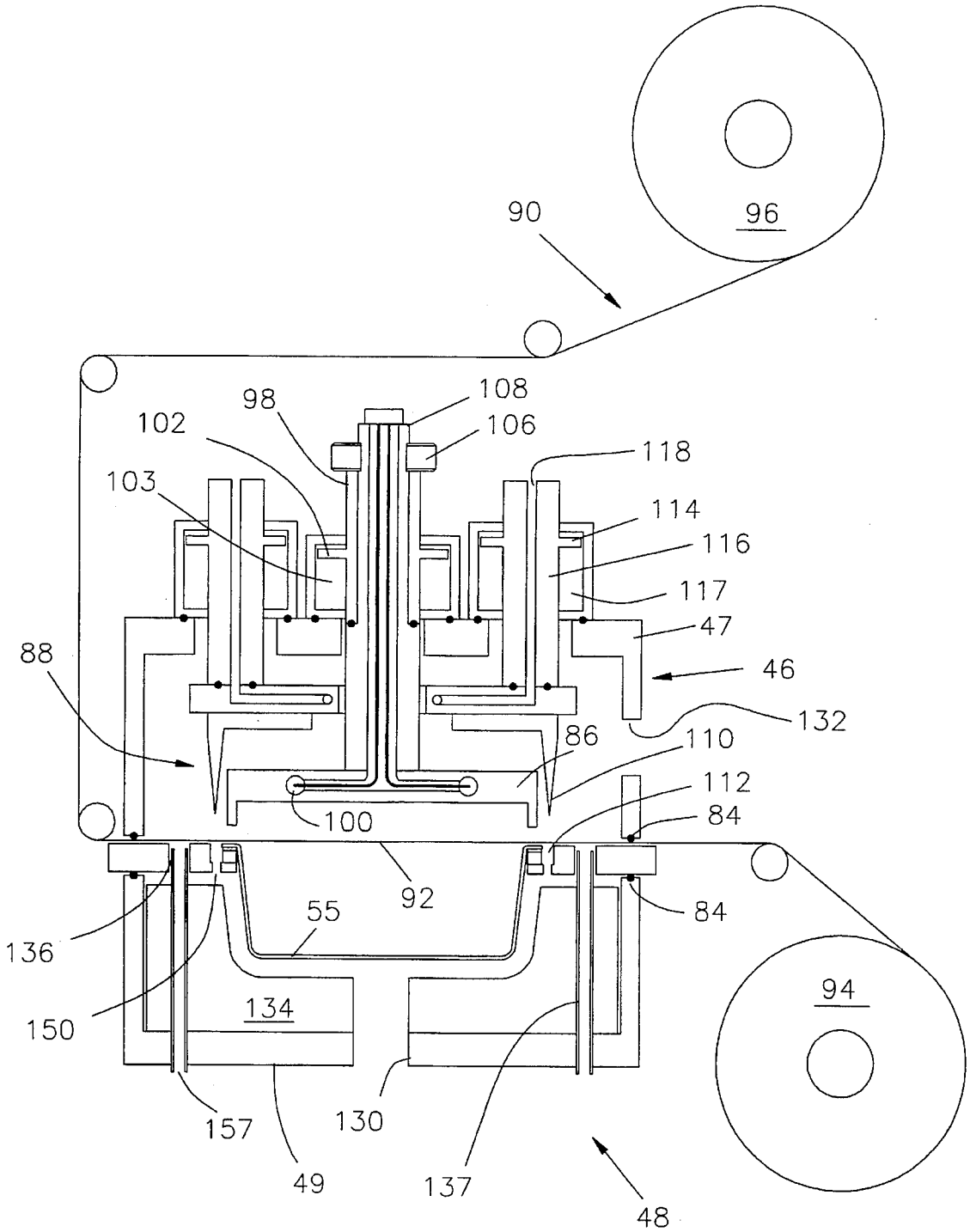
FIG. 10 is an enlarged, cross-sectional view taken generally along the line 10—10 in FIG. 9.

The configuration of the upper and lower portions 46 and 48 of the tooling assembly 44, shown in FIG. 10, includes a sealer 86, a cutter 88, and a web winding system 90. The web 92 may be unrolled from a roll 94, processed inside the tooling assembly 44 and transferred to a waste roll 96. The film 92 may be made of any plastic film used for food packaging including composite films of plastic, aluminum foil, paper, or cardboard.

With the film 92 positioned over the tray 55, it may be sealed by the sealer 86 which is mounted on a shaft 108. The seal bar may be telescopically reciprocated up and down at the appropriate times in order to seal the film 92 to the tray 55. A wide variety of sealers 86 may be utilized, however one conventional sealer uses electrical resistance heaters 100 in order to heat seal the film to the tray 55. The extent of upward and downward movement of the shaft 108 is controlled by the medial stops 102 under the influence of a conventional fluid energy source. The medial stops 102 are part of a tube 98 which is sealing secured to the shaft 108.

The sealer 86 may be removed from the mechanism for repair or cleaning when desired simply by unthreading the nut 106. When this is done, the shaft 108 and sealer 86 may be removed downwardly from the mechanism.

The cutter 88 includes a pair of blades 110 positioned to enter the recess 112 in the platform 24. These blades cut the film 92 completely around the upper circumference of the tray so that it conforms to the configuration of the tray 55. Of course, any conventional severing technique may be utilized including cutting or heat severing. Also, more than one web or film may be severed for attachment to the tray 55. Like the sealer 86, the cutter 88 reciprocates upwardly and downwardly around the sealer 86. It is controlled by stops 114 on arms 116 under the influence of a conventional fluid energy source.

The cutter 88 also includes an internal coolant circulation passage 118. Connected to a source of external cooling liquid, the passage 118 provides a medium for cooling the cutter 88. The cutter 88, in close proximity to the sealer 86, is subject to possible heat related malfunctions. By cooling the cutter 88, the precision of the cutting operation may be maintained even in a relatively hot environment.

The lower chamber 49 contains a gas exchange passage 130 in its lower surface, while the upper chamber 47 includes a gas exchange passage 132 in its side wall. The lower portion 48 may include filler 134. Each platform 24 includes a plurality of gas exchange passages 136. The gas exchange passage 132 communicates with a vacuum source by way of the quick disconnect device 138, shown in FIG. 9. That device is secured to the upper chamber 47 by threaded knobs 140. Similarly, device 142 is connected by threaded knobs 144 to lower chamber 49 to provide gas exchange via opening 130.

Figure 9:
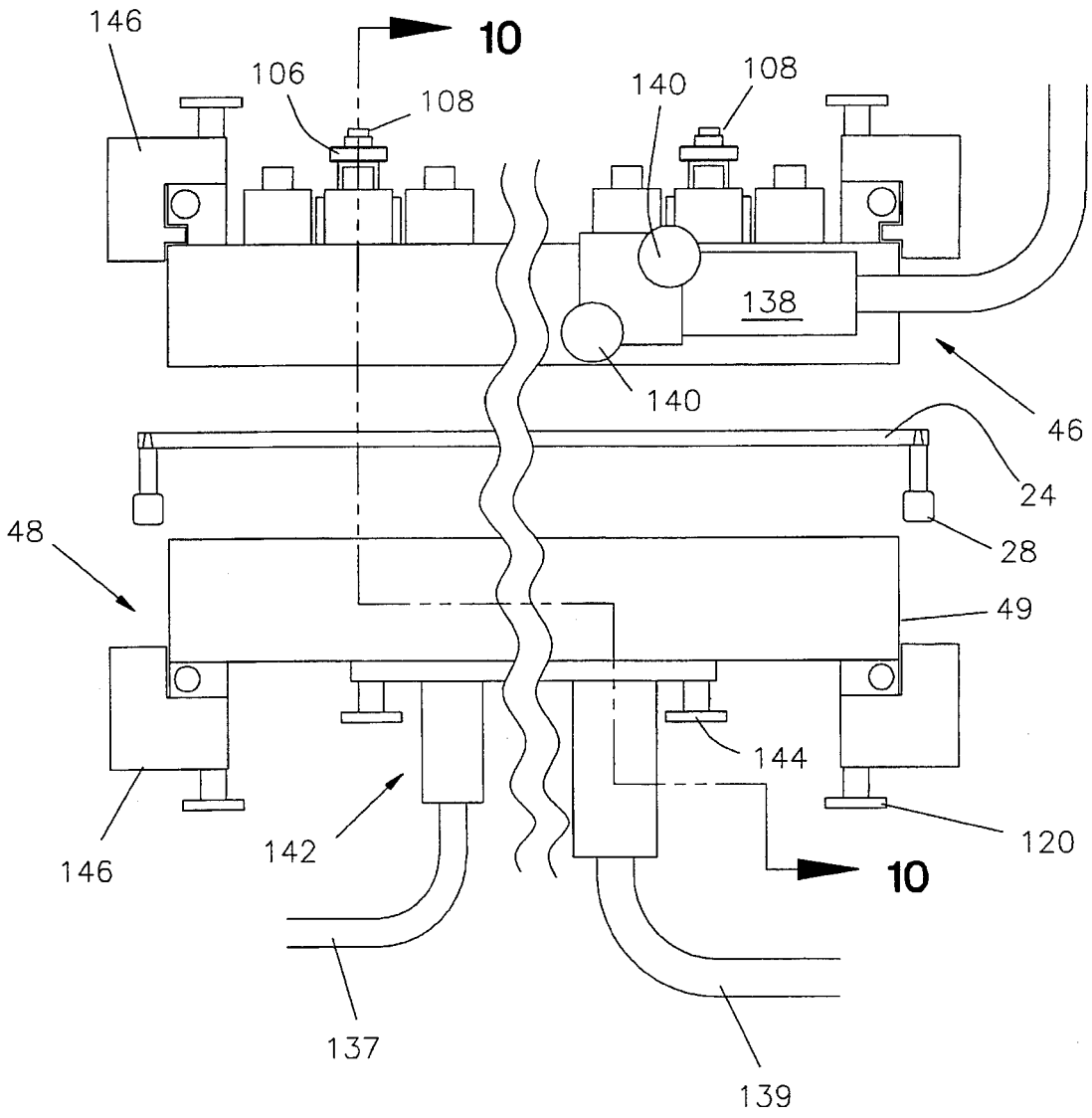
FIG. 9 is an enlarged, plan view of the quick disconnect tooling at the station 22*a;*

Referring to FIG. 9, it is evident that the connections to the upper and lower portions 46 and 48 are all of the quick disconnect variety so that the machinery associated with any particular station 22 may be readily removed from the remainder of the machine 20. Moreover, the connections for power and fluid may likewise be of the quick disconnect variety. Thus, the connections such as those shown at 120 may be disconnected by simply pulling them apart or unscrewing them and then the mechanisms 146 holding the upper and lower chambers 47 and 49 may be disconnected in the same fashion so that the upper and lower chambers 47 and 49 may be quickly removed.

Figure 11:
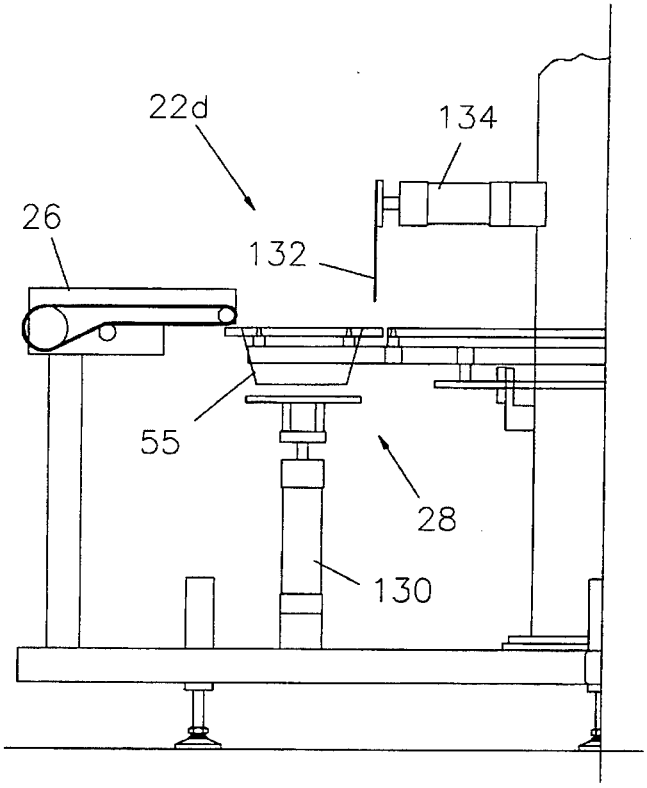
FIG. 11 is a partial, side elevational view of the unloading station.
Figure 13:
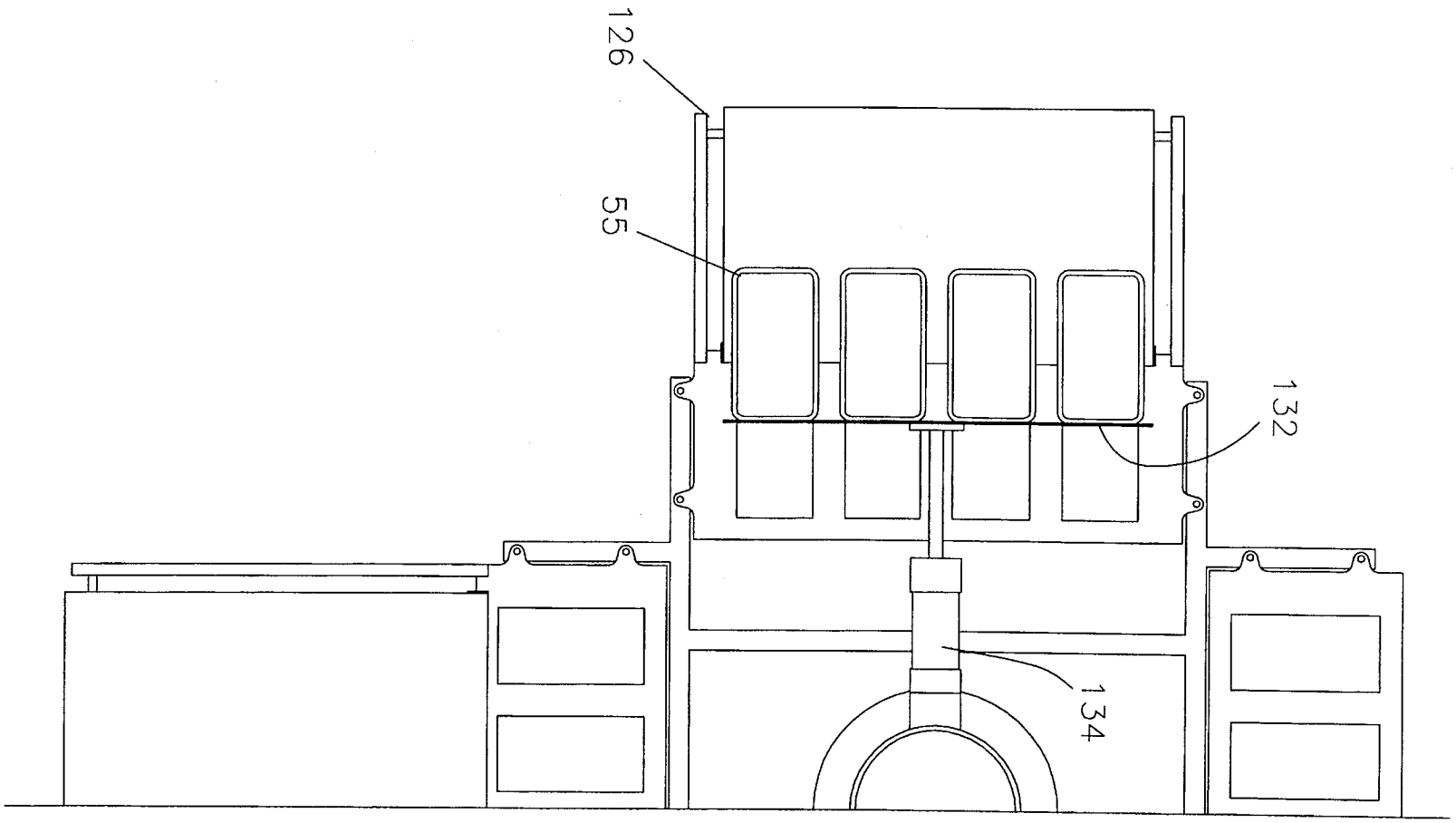
FIG. 13 is a top plan view of the embodiment shown in FIG. 12 after the trays have been pushed onto the unloading conveyor.

The unloading station 22*d*, shown in FIG. 11, includes an unloading conveyor 126 and a tray pusher 128. At the appropriate time, the trays 55 in a platform 24 are pushed upwardly by the cylinder 130 of the pusher 128. Then the trays are pushed laterally by the slider 132 powered by cylinder 134. The trays are pushed onto the conveyor 126 as indicated in FIG. 13.

Figures 3, 4:
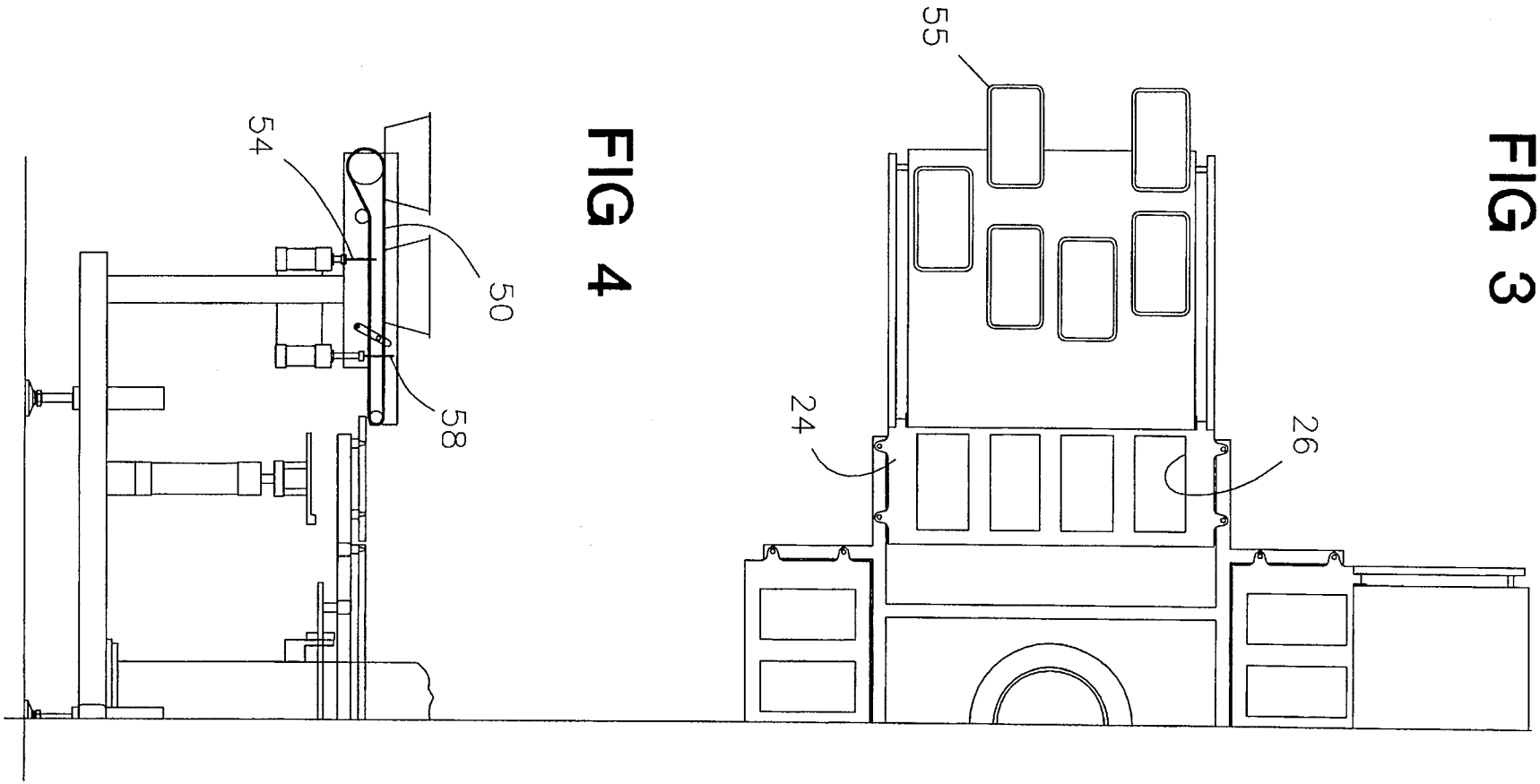
FIG. 3 is an enlarged top plan view of a portion of the embodiment shown in FIG. 1, showing the loading area receiving trays to be packaged.
FIG. 4 is a front elevational view of the portion shown in FIG. 3.

The machine is operated generally as follows. Initially, a plurality of trays 55 are organized on the conveyor 50 of the tray load assembly 42. As indicated in FIGS. 3 and 4, the trays are formed into two rows of four trays through the operation of the stop bars 54 and 58. Trays are originally allowed to ride up against stop bar 58 so that they slide relative to the rotating conveyor 50. A second row of trays then back up to the first row of trays.

Figure 6:
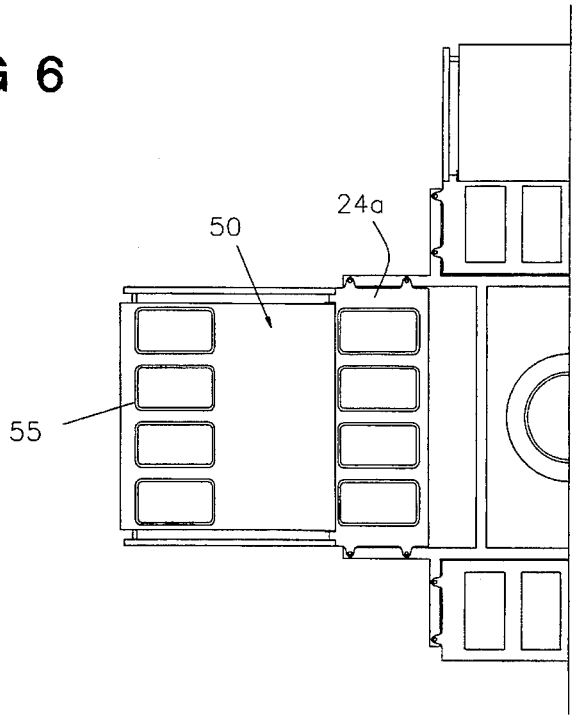
FIG. 6 is a top plan view of the portion shown in FIG. 5.

As shown in FIGS. 5 and 6, at the appropriate time, the second stop bar 58 is lowered allowing the first row of trays to pass on to the bed 64. Each bed 64 is thereafter lowered so that each troy 55 is held in a slot 26 in the platform 24.

After a passage of time, the platform 24 is rotated 90 degrees to the station 22*b*. Thereafter, the stop bar 58 is operated to allow the second row of trays 55 to be loaded into a subsequent platform 24 rotated into station 22*a* from station 22*d*. From station 22*b*, the platform 24 rotates into the station 22*c* as shown in FIG. 1.

As shown in FIGS. 7 and 8, at the tooling assembly 44, the platform 24 is lifted from its supports 72 and held between the upper chamber 47 and lower chamber 49 of assembly 44. Precise alignment is achieved through the operation of the pins 78 which engage mating holes 82 in the platform 24. The tapered portions on the pins 78 and holes 82 interact to guide the platform into the desired portion within the station. In this way, the trays 55 are precisely positioned with respect to the tooling assembly.

After the platform 24 is in position, a vacuum is drawn in the upper chamber 47 through the gas exchange passage 132. This is possible since the upper chamber 47 sealingly engages the film 92 through o-ring seals 84. After the drawing of a vacuum is begun in upper chamber 47, a vacuum is begun to be drawn in the lower chamber 49 via a vacuum tube 139. This is possible because the lower chamber 49 sealingly engages the platform 24, against the upper chamber 47, through an o-ring seal 84.

As a result, good fluid communication is achieved with the exterior of the tray 55, under the film 92. This is because the vacuum in the upper chamber 47 lifts the film 92, allowing air to be exhausted from the tray 55 through a series of holes on slots 150 in the bottom of recess 112 of the platform and out the opening 130. The provision of the filler 134 makes this process proceed more quickly.

After the vacuum is drawn, a desired atmosphere is then pumped into the tray via the openings 151 and 136 from the gas tube 137. This atmosphere is preferably one which is reduced in oxygen content to extend the life of the packaged food product.

As shown in FIG. 10, the film 92 may be heat sealed to the tray 55 using the sealer 86. This operation may be a conventional heat sealing operation. The sealer 86 reciprocates downwardly finder the control of the stops 102 in response to changing fluid pressure in the chamber 103.

After the film 92 is sealed to the tray 55, the film is cut by cutter 88. The cutter 88 reciprocates downwardly to cut the film 92, eventually entering the recess 112. The movement of the cutter 88 is controlled by the fluid pressure in the chamber 117. In this way the desired atmosphere may be sealed into the package. Of course, other gas exchange techniques may be utilized as well. Advantageously, the atmosphere inside the assembly 44 is reduced in oxygen content so that the food product will have a longer useful life.

The operation of the cutter 88 may be adversely affected by the ambient heat within the assembly 44 which is greatly augmented by the heat created by the heat sealing operation. This heat may distort the cutting blades and cause inaccuracies therein. For this reason, a source of cooling fluid, for example water, may be circulated through the passage 118 so as to cool the cutter 88.

After this operation is complete, the upper chamber 47 and lower portion 49 may be moved apart and the rolls 96 and 94 advanced so as to bring a new section of film into position between the chambers 47 and 49. Trays 55 are then advanced to the next station 26*d*.

Figure 12:
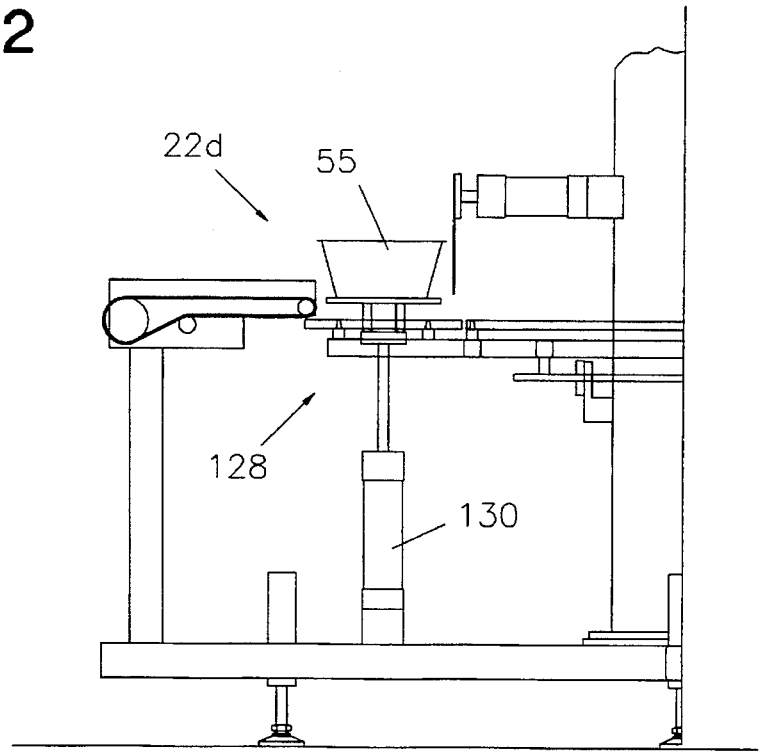
FIG. 12 is a partial, side elevational view of the unloading station after a platform has been raised to an "up" position.

As shown in FIG. 11, in station 22*d* the trays 55 are positioned over the tray pushers 128 and cylinders 130. At the appropriate time, one or more trays 55 are pushed upwardly through the action of the cylinders 130 and pushers 128 as shown in FIG. 12. Thereafter, the trays may be pushed laterally by the slider 132 and its cylinder 134 as shown in FIG. 13. Then the trays may be taken away from the rotary conveyor by the unloading conveyor 126.

The entire operation is facilitated by the rotary arrangement of the stations 22. The operation of the conveyor is continuous since it is laid out in the rotary arrangement. In this way, problems arising from the need to return the platforms 24 to the initial position at the end of a linear conveyor are eliminated.

Figure 14:
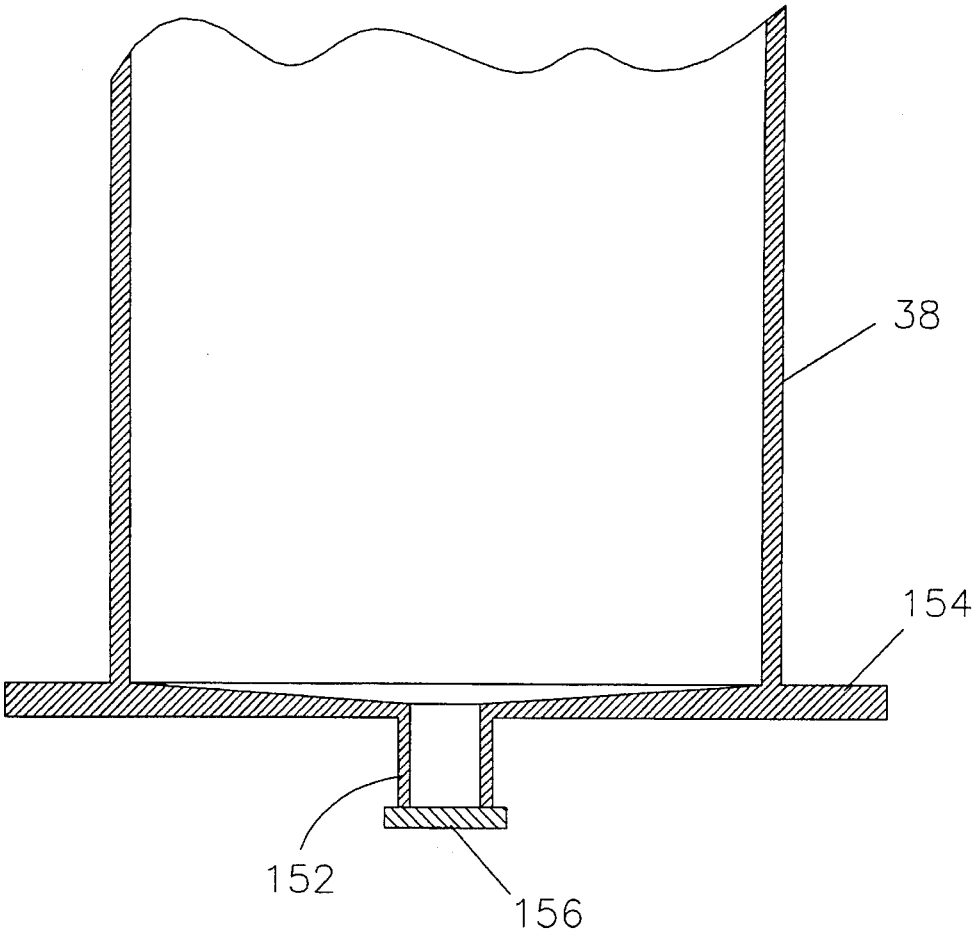
FIG. 14 is an enlarged, partial, cross-sectional view of the bottom of the surge tank.

Moreover, with the rotary arrangement the central area may be occupied by the conveniently located surge tank 38. This tank supplies a source of fluid pressure for the various operations in the surrounding rotary conveying apparatus. The tank 38 is normally closed by caps 154 on both ends. As shown in FIG. 14, a drain 152 is provided at the bottom of the surge tank 38 for releasing a sanitizing solution. The drain may be closed by a removable cover 156. The interior of the tank 38 may be washed with the bacteriostatic solution to minimize bacteria transfer to the packaging. The tank 38 also provides the support for the drive mechanism 32 and rotatable ring 30.

In addition, because of the rotary arrangement of the conveyor, any particular station may be easily accessed for removal from the rest of the machine. Any particular station may be easily replaced with a more appropriate station for any particular operation. Also, a malfunctioning apparatus may be replaced with a working apparatus. Because of the rotary arrangement, access to the individual stations for repair is facilitated.

Repair and replacement is also facilitated by making the various connections to the stations for electrical and fluid power of the quick disconnect variety. Moreover, by making the means of attachment of the particular apparatus to each station of a quick disconnect variety it is possible to change stations quickly to convert the machine for other uses or to replace a broken piece of equipment.

While the present invention has been described with respect to one preferred embodiment, those skilled in the an will appreciate numerous modifications and variations therefrom. The appended claims are intended to covet all such modifications and variations which occur to one of ordinary skill in the art.

What is claimed is:

1. An apparatus for making modified atmosphere packages comprising:

a plurality of packaging stations, including at least one station for loading a food product into trays;

a rotary conveyor for moving said trays from one station to the next, said rotary conveyor including a platform for carrying a plurality of trays;

one of said packaging stations adapted to load said trays on said platform, and another of said stations adapted to unload said trays from said platform;

an apparatus for replacing the ambient atmosphere in said trays with an atmosphere reduced in oxygen content;

a mechanism for displacing said platform from a first position on one of said stations upwardly to a second position still aligned with said station; and one of said stations including means for severing a film from a continuous web and means for heat sealing the film to a tray.

2. The apparatus of claim 1, wherein said platform is removably mounted on said conveyor.

3. The apparatus of claim 1, including a mechanism for enclosing a platform inside a substantially gas tight enclosure, said mechanism further including a device for removing the atmospheric gas, sealing the package with a film and severing the film from the package.

4. The apparatus of claim 3, wherein said enclosing mechanism includes a pair of open-ended chambers, at least one of which is movable toward the other so as to form at least one substantially airtight chamber.

5. The apparatus of claim 4, wherein a pair of opposed substantially airtight chambers are defined, at least one of said chambers adapted to seal against film used to cover said trays.

6. The apparatus of claim 1, including a mechanism for automatically aligning a platform with a station.

7. The apparatus of claim 6, wherein said mechanism includes a pair of pins mounted on the station, adapted to interact with apertures in said platform in a fashion which automatically indexes the platform to the station.

8. The apparatus of claim 7, wherein said pins include tapered upper portions which mate with tapered portions in said apertures in said platform.

9. The apparatus of claim 8, wherein said platforms are removably mounted on said conveyor.

10. The apparatus of claim 1, wherein gas and vacuum supply connections are provided which are quick disconnect connections.

11. The apparatus of claim 3, wherein gas supply valving is mounted directly to said mechanism to facilitate a fast gas supply reaction time and low usage of gas.

12. The apparatus of claim 3, wherein said vacuum supply valving is mounted directly to said mechanism to facilitate a fast vacuum supply reaction time to evacuate tooling.

13. The apparatus of claim 1, wherein said heating and sealing means telescopically reciprocate with respect to one another.

14. The apparatus of claim 13, wherein said severing means includes an internal cooling passage.

15. The apparatus of claim 1, wherein said stations are arranged around a tubular support.

16. The apparatus of claim 15, wherein said tubular support is capped on both ends to serve as a surge tank which provides a supply of gas for various operations at said stations.

17. The apparatus of claim 16, wherein said tubular support includes a drain for releasing a solution that is used to sanitize the inside of the surge tank to minimize bacteria transfer into the package during the gas exchange of atmosphere in the package.

18. The apparatus of claim 15, including a drive system for the rotary conveyor, said drive system mounted on said tubular support.

19. The apparatus of claim 1, wherein the center of the machine is the support structure that supports the rotary conveyor.

20. The apparatus of claim 1, wherein said rotary conveyor is arranged around a surge tank which provides a supply of gas for various operations at said stations.

21. The apparatus of claim 1, including a support, said stations being removably connected to said support.

22. A method for making modified atmosphere packaging comprising the steps of:

loading a plurality of trays on a platform resting on a support on a rotary conveyor;

indexing said trays between a plurality of stations arranged in a circular path;

aligning said platform to said station;

displacing said platform upwardly from said support to a raised position;

aligning said platform in its raised position with said conveyor;

aligning said trays precisely with said station after said trays arrive at said station;

withdrawing the atmosphere from within a tray after a food product has been added;

covering said tray with a film so as to maintain an atmosphere reduced in oxygen content within the tray;

sealing the film to the tray;

severing the film; and lifting said platform from said conveyor after said platform arrives at a station.

23. The method of claim 22, including the step of aligning said trays precisely with said station after said trays arrive at the station.

24. The method of claim 23, wherein said aligning step includes the steps of engaging apertures in said platform to remove said platform from said conveyor and guiding said platform into alignment with said station.

25. The method of claim 22, including the steps of severing the film from a roll of film material and then heat sealing said film to said trays, said method further including the step of providing internal cooling fluid to the mechanism for severing the film.

26. The method of claim 22, including the step of enclosing said trays in a gas tight environment at one station or, said rotary conveyor, removing the gaseous environment from within the enclosure and providing a desired gaseous environment within this enclosure, and sealing the trays closed with a film so as to maintain the desired gaseous environment within the package.

27. The method of claim 22, wherein said trays are loaded onto a rotary conveyor by the steps of pushing said trays onto supports in said conveyor, and then lowering said supports such that said trays engage said conveyor platforms.

28. The method of claim 22, including the steps of placing a film over said trays, defining at least one substantially gas-tight chamber, drawing a vacuum over said film to lift said film away from said trays, withdrawing the atmosphere from within said trays, and thereafter providing the desired atmosphere to the interior of said trays.

29. The method of claim 28, including the step of sealing a film to said trays within said substantially gas-tight chamber, said sealing step including the step of reciprocating a sealing bar towards and away from said film, and removing said sealing bar from said chamber by unthreading a fastener on the exterior of said chamber.

30. An apparatus for making modified atmosphere packages comprising:

a plurality of packaging stations, including at least one station for loading a food product into trays;

a rotary conveyor for moving said trays from one station to the next, said rotary conveyor including a platform for carrying a plurality of trays;

one of said packaging stations adapted to load said trays on said platform, and another of said stations adapted to unload said trays from said platform;

an apparatus for replacing the ambient atmosphere in said trays with an atmosphere reduced in oxygen content; and one of said stations including a film supplying device, a film severing device and a device for sealing a film to said trays, said severing and sealing devices being reciprocatable relative to one another, the severing device including an internal passage for cooling fluids to prevent the heat of the sealing device from interfering with the severing operation.

31. An apparatus for making modified atmosphere packages comprising:

a plurality of packaging stations, including at least one station for loading a food product into trays;

a rotary conveyor for moving said trays from one station to the next, said rotary conveyor including a platform for carrying a plurality of trays;

one of said packaging stations adapted to load said trays on said platform, and another of said stations adapted to unload said trays from said platform;

an apparatus for covering said trays with film; and an apparatus for replacing the ambient atmosphere in said trays with an atmosphere reduced in oxygen content after covering said trays with a film, said apparatus adapted to lift said film to be sealed to the trays from said trays to provide head space for gas exchange.

32. The apparatus of claim 31 wherein said apparatus includes a vacuum mechanism for lifting said film.

33. A method for making modified atmosphere packaging comprising the steps of:

loading a plurality of trays on a platform resting on a support on a rotary conveyor;

indexing said trays between a plurality of stations arranged in a circular path;

displacing said platform upwardly from said support to a raised position;

aligning said platform in its raised position with said conveyor;

withdrawing the atmosphere from within a tray after a food product has been added;

covering said tray with a film so as to maintain an atmosphere reduced in oxygen content within the tray by severing the film from a roll of film material and then heat sealing said film to said tray, and providing internal cooling to the mechanism for severing the film; and unloading said trays from the rotary conveyor.

34. A method for making modified atmosphere packaging comprising the steps of:

loading a plurality of trays on a platform resting on a support on a rotary conveyor;

indexing said trays between a plurality of stations arranged in a circular path;

displacing said platform upwardly from said support to a raised position;

aligning said platform in its raised position with said conveyor;

aligning said trays precisely with said station after said trays arrive at the station by engaging apertures in said platform to remove said platform from said conveyor and guiding said platform into alignment with said station;

withdrawing the atmosphere from within a tray after a food product has been added;

covering said tray with a film so as to maintain an atmosphere reduced in oxygen content within the tray; and unloading said trays from the rotary conveyor.

35. A method for making modified atmosphere packaging comprising the steps of:

loading a plurality of trays on a platform resting on a support on a rotary conveyor by pushing said trays onto supports in said conveyor and then lowering said supports such that said trays engage said conveyor supports;

indexing said trays between a plurality of stations arranged in a circular path;

displacing said platform upwardly from said support to a raised position;

aligning said platform in its raised position with said conveyor;

withdrawing the atmosphere from within a tray after a food product has been added;

covering said tray with a film so as to maintain an atmosphere reduced in oxygen content within the tray; and unloading said trays from the rotary conveyor.

36. A method for making modified atmosphere packaging comprising the steps of:

loading a plurality of trays on a platform resting on a support on a rotary conveyor;

indexing said trays between a plurality of stations arranged in a circular path;

displacing said platform upwardly from said support to a raised position;

aligning said platform in its raised position with said conveyor;

withdrawing the atmosphere from within a tray after a food product has been added;

covering said tray with a film so as to maintain an atmosphere reduced in oxygen content within the tray by placing a film over said tray, defining at least one substantially gas-tight chamber, drawing a vacuum over said film to lift said film away from said tray and providing the desired atmosphere to the interior of said tray; and unloading said trays from the rotary conveyor.

37. The method of claim 36, including the step of sealing a film to said trays within said substantially gas-tight chamber, said sealing step including the step of reciprocating a sealing bar towards and away from said film, and removing said sealing bar from said chamber by unthreading a fastener on the exterior of said chamber.

38. An apparatus for making modified atmosphere packages comprising:

a plurality of packaging stations, including at least one station for loading a food product into trays;

a rotary conveyor for moving said trays from one station to the next, said rotary conveyor including a platform for carrying a plurality of trays;

one of said packaging stations adapted to load said trays on said platform, and another of said stations adapted to unload said trays from said platform;

an apparatus for replacing the ambient atmosphere in said trays with an atmosphere reduced in oxygen content, said apparatus including an enclosing mechanism for enclosing a platform inside a substantially gas-tight enclosure, said mechanism further including a device for removing the atmospheric gas, sealing the package with a film, and severing the film from the package, said enclosing mechanism including a pair of opposed, substantially air-tight, open-ended chambers, at least one of which is movable toward the other so as to form at least one substantially airtight chamber, at least one of said chambers adapted to seal against the film used to cover said trays; and a mechanism for displacing said platform from a first position on one of said stations upwardly to a second position still aligned with said station.

39. An apparatus for making modified atmosphere packages comprising:

a plurality of packaging stations, including at least one station for loading a food product into trays;

a rotary conveyor for moving said trays from one station to the next, said rotary conveyor including a platform for carrying a plurality of trays;

a mechanism for automatically aligning a platform with a station, said mechanism including a pair of pins mounted on the station, and adapted to interact with apertures in said platform in a fashion which automatically indexes the platform to the station;

one of said packaging stations adapted to load said trays on said platform, and another of said stations adapted to unload said trays from said platform;

an apparatus for replacing the ambient atmosphere in said trays with an atmosphere reduced in oxygen content; and a mechanism for displacing said platform from a first position on one of said stations upwardly to a second position still aligned with said station.

40. The apparatus of claim 39, wherein said pins include tapered upper portions which mate with tapered portions in said apertures in said platform.

41. The apparatus of claim 40, wherein said platforms are removably mounted on said conveyor.

42. An apparatus for making modified atmosphere packages comprising:

a plurality of packaging stations, including at least one station for loading a food product into trays;

a surge tank for providing a supply of gas for various operations at said stations;

a rotary conveyor, arranged around said surge tank, for moving said trays from one station to the next, said rotary conveyor including a platform for carrying a plurality of trays;

one of said packaging stations adapted to load said trays on said platform, and another of said stations adapted to unload said trays from said platform;

an apparatus for replacing the ambient atmosphere in said trays with an atmosphere reduced in oxygen content; and a mechanism for displacing said platform from a first position on one of said stations upwardly to a second position still aligned with said station.

43. The apparatus of claim 42, wherein said tubular support includes a drain for releasing a solution that is used to sanitize the inside of the surge tank to minimize bacteria transfer into the package during the gas exchange of atmosphere in the package.

44. An apparatus for making modified atmosphere packages comprising:

a plurality of packaging stations, including at least one station for loading a food product into trays;

a tubular support having ends, said stations begin arranged around said tubular support, said tubular support being capped on both ends to serve as a surge tank which provides a supply of gas for various operations at said stations;

a rotary conveyor for moving said trays from one station to the next, said rotary conveyor including a platform for carrying a plurality of trays;

one of said packaging stations adapted to load said trays on said platform, and another of said stations adapted to unload said trays from said platform;

an apparatus for replacing the ambient atmosphere in said trays with an atmosphere reduced in oxygen content; and a mechanism for displacing said platform from a first position on one of said stations upwardly to a second position still aligned with said station.

* * * * *